United States Patent [19]

Belt

[11] 4,236,473

[45] Dec. 2, 1980

[54] METHOD OF MAKING METAL BEAM FOR GEODESIC DOME STRUCTURE

[76] Inventor: Wesley D. Belt, 10553 Rountree Rd., Los Angeles, Calif. 90064

[21] Appl. No.: 29,643

[22] Filed: Apr. 13, 1979

[51] Int. Cl.[3] ..... B21D 47/01

[52] U.S. Cl. ..... 113/116 HA; 113/116 HH; 29/150; 29/155 R

[58] Field of Search ..... 29/155 R, 155 C, 150; 113/116, 116 HA, 116 F, 116 V, 116 HH; 52/81, 86, DIG. 10

[56] References Cited

U.S. PATENT DOCUMENTS

| | | | |
|---|---|---|---|
| 2,736,072 | 2/1956 | Woods | 52/81 |
| 3,094,197 | 6/1963 | Attwood | 29/155 R X |

*Primary Examiner*—Francis S. Husar
*Assistant Examiner*—C. J. Arbes
*Attorney, Agent, or Firm*—Gene W. Arant

[57] ABSTRACT

A beam for a triangular wall section of a geodesic dome structure is made from a single rectangular sheet of metal. The longitudinal side edges of the metal sheet are bent to form a parallel pair of side walls that are non-perpendicular to the flat central base section that lies between them. The extremities of the side walls are curled inwardly. Each end of the beam thus formed is cut along a plane which lies perpendicular to the side walls but at an acute angle to the base section. Holes are formed in the base section for bolting it in back-to-back relation to the base section of another similar beam.

3 Claims, 5 Drawing Figures

METHOD OF MAKING METAL BEAM FOR GEODESIC DOME STRUCTURE

RELATED APPLICATION

The present invention has been initially disclosed in my copending U.S. Pat. Application Ser. No. 812,570 filed July 5, 1977 and now U.S. Pat. No. 4,149,346.

BACKGROUND OF THE INVENTION

Many designs of geodesic dome structures have been devised but so far as I am aware all of them utilize wooden beams for forming the edges of the triangular wall sections that make up the main portion of the structure.

In geodesic dome structures it is common practice to fabricate each triangular wall section with an exterior panel which is fastened to the exterior surfaces of the three beams forming the edges of the wall section. Then when the wall sections are fastened together to form the complete structure an interior finish panel is fastened to the interior side of each wall section, being attached to the interior sides of the beams. In the completed form of the structure, therefore, each wall section includes parallel exterior and interior panels which are separated by the thickness of the beams.

Particularly in cold climates or in any time or location where energy conservation is of premium importance, it is also the practice to insert an insulating material between the panels of the wall section. The effectiveness of the insulating material depends upon its thickness, which is the same as the thickness of the beams.

I have concluded that it is uneconomical to make very thick beams of wood, because of the immense wastage of material. I have therefore concluded that it is advantageous to make the beams of metal providing the metal can be formed in such a way as to utilize the material effectively while at the same time maintaining necessary structural strength.

Even where heat insulation and hence the thickness of the beams is not of premium importance, I believe there is a potentially great advantage in constructing a geodesic dome with a metal frame, providing that the various members of the metal frame structure are shaped in such a way that the inherent structural capability of the metal is effectively utilized, and also provided that the metal members can be fastened together in a way which is structurally strong but does not require excessive labor either in the factory or at the construction site.

The object of the present invention is to provide a method of making a metal beam for a geodesic dome structure, which method can be simply and economically carried out, and which produces a beam that will be structurally effective when incorporated into the geodesic dome.

SUMMARY OF THE INVENTION

According to the present invention a metal beam for use in a geodesic dome structure is made from a single generally rectangular sheet of metal. The longitudinal sides of the metal sheet are bent upwardly so as to leave a flat central base section bordered by two side walls. The side walls are parallel to each other but are not perpendicular to the base section, one side wall being inclined inwardly while the other is inclined outwardly.

The upper extremities of both side walls are also curled inwardly towards the base section.

Thereafter each end of the metal beam thus formed is cut at an acute angle to it base section, so that three similar beams can be fitted together at their ends to form a triangular frame. More specifically, each end of the beam is cut along a plane that is perpendicular to the side walls and lies at an acute angle to the base section of the beam.

A plurality of holes are cut in the base section so that, when two triangular wall sections are placed in side-by-side relation, the base section of the particular beam may be tightly bolted to the base section of the adjacent beam that is in mating engagement with it.

DRAWING SUMMARY

DETAILED DESCRIPTION

Figure 1:
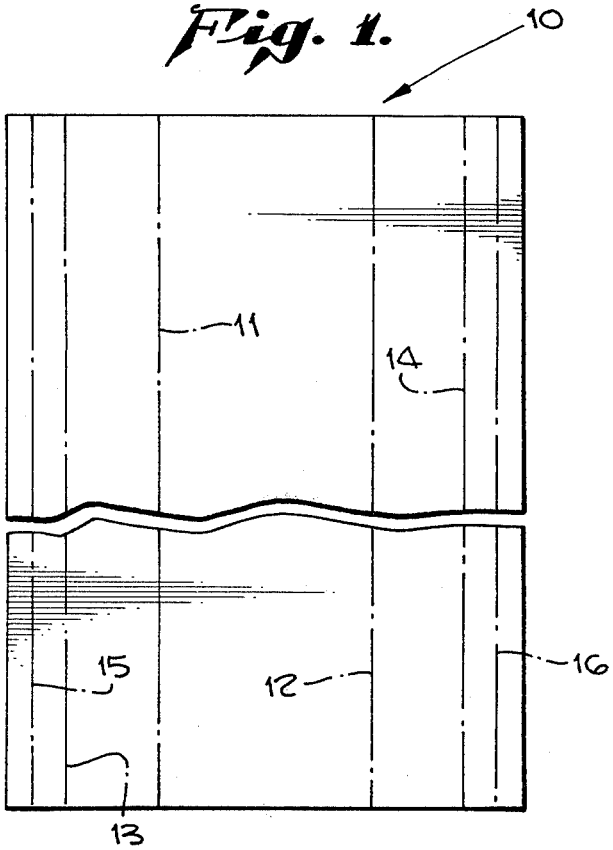
FIG. 1 is a plan view of a sheet of metal, with dotted lines showing where it is to be bent or folded.

As shown in FIG. 1 a flat sheet of metal 10 is of generally rectangular configuration. Since the length of the sheet is considerably greater than its width a large portion of the longitudinal center of the sheet is omitted from FIG. 1, as indicated by the meandering cut lines at the center of the view. Center portions are similarly omitted in FIGS. 3 and 4.

In FIG. 1 a first parallel pair of dotted lines 11, 12 indicate where the longitudinal sides of the sheet are to be bent upwardly to form side walls. A second pair of dotted lines 13, 14 indicate where the tops of the side walls are to be bent inwardly. And a third pair of dotted lines 15, 16 indicate where the inwardly bent portions of the side walls are to be bent downwardly.

Figure 2:
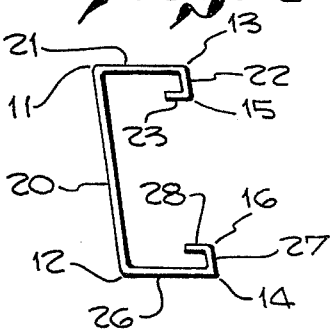
FIG. 2 is an end view of the beam after the folding or bending of the edges of the sheet of FIG. 1 has been completed.

FIG. 2 is an end view of the sheet 10 after the various bending or folding operations have been completed. This is also the cross-sectional configuration of the completed beam. There is a flat central base section 20, a flat upper side wall 21, and a flat lower side wall 26. The two side walls are parallel to each other but are not perpendicular to the base section 20. Upper side wall 21 is inclined inwardly toward the base section, at an angle which may for example be about 83 degrees. Lower side wall 26 is inclined outwardly from the base section, and if the angular relationship of the upper side wall to the base section is 83 degrees then the angular relation of the lower side wall to the base section is 97 degrees.

The remote ends of both of the side walls are curled inwards towards the base section. However, in the particular example shown, in accordance with the preferred form of the invention, the curled portion of each side wall is formed as two flat sections. Thus the side wall 21 has a relatively narrow flange section 22 which is preferably formed precisely parallel to the base section 20, while side wall 26 has a similar flange section 27 that is also parallel to the base section. Then at the extremity of flange 22 there is another narrow flange 23 that is turned towards the base section 20 and aligned parallel to the wall 21. In similar fashion a narrow flange 28 extending from flange 27 is parallel to the side wall 26.

All of the bending lines which are shown in FIG. 1 as dotted lines become corners after the bending operation is completed. Therefore, as shown in FIG. 2 there are six corners designated 11 through 16, inclusive, where the various folding or bending operations have taken place.

The position or attitude of the beam as shown in FIG. 2 is indicative of the position or attitude that it will have when incorporated into a geodesic dome structure, that is, the inwardly inclined side wall 21 is the upper side of the beam while the outwardly inclined side wall 26 is the lower side. And the flat central base section 20 is aligned in a position which may be fairly close to vertical, depending upon where the particular beam is located in the structure.

Figure 3:
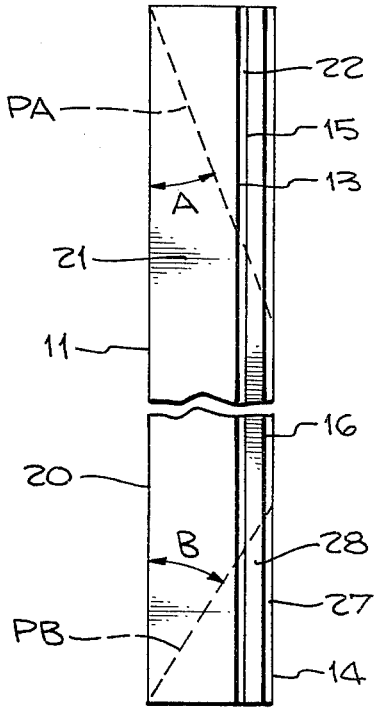
FIG. 3 is a top plan view of the beam with dotted lines indicating the planes along which the ends of the beams are to be cut.

FIG. 3 shows how the ends of the beam are cut. In FIG. 3 the upper surface is taken as the side wall 21, being perfectly horizontal. The flanges 22 and 27 are visible to a small extent and the flange 28 to a much greater extent. The flat central base section 20, being tapered underneath the upper side wall 21, is visible only along the line where it forms a juncture with that side wall. This juncture is also the bending corner 11, as previously described.

One of the vertical cutting planes shown in FIG. 3 by means of dotted lines is designated as PA. This cutting plane is precisely perpendicular to both of the side walls 21 and 26, and lies at an acute angle A to the bending corner 11 of the flat central base section 20. Although base section 20 is not perpendicular to the side walls, but inclines inwardly underneath the the upper side wall 21 (as viewed in FIG. 3), the lower edge of base section 20 nevertheless extends at the same acute angle A relative to the cutting plane PA.

At the other end of the beam as shown in FIG. 3 the cutting plane PB is also indicated by a dotted line. Cutting plane PB is also perpendicular to both of the side walls 21 and 26. It is inclined at the acute angle B relative to central base section 20. The angle A as shown in FIG. 3 may be about 22 degrees while angle B may be about 33 degrees. These figures are merely indicative of the approximate value of the angle in the particular embodiment as shown.

Figure 4:
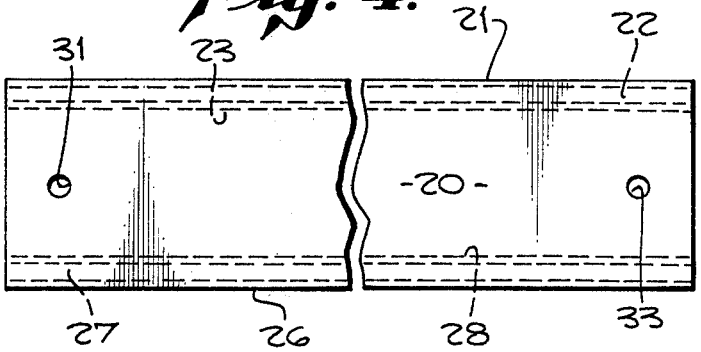
FIG. 4 is an elevation view of the back side of the complete beam showing holes cut in its base section.

FIG. 4 is a side elevation view taken from the left side of the beam as it appears in FIG. 2, and showing the outer surface of central base section 20. A plurality of bolt holes such as holes 31, 33 are formed in the base section 20.

Figure 5:
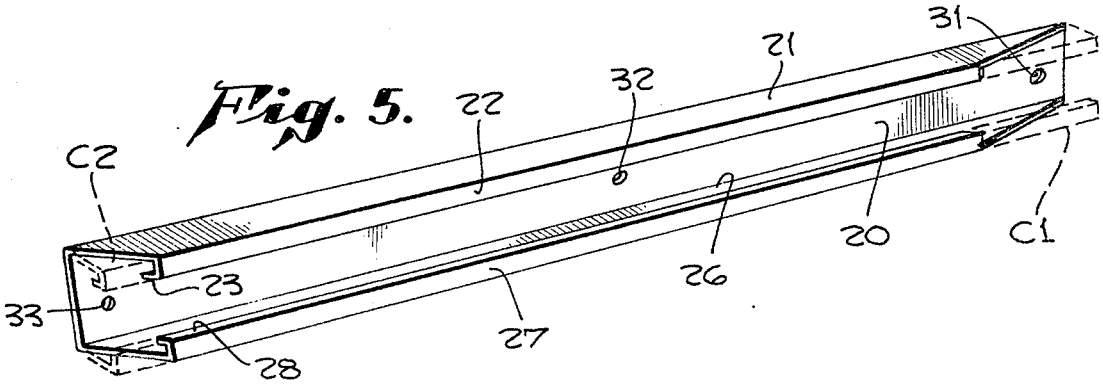
FIG. 5 is a perspective view of the completed beam showing in dotted lines the portions of the end walls that were cut off.

FIG. 5 is a perspective view of the completed beam after the ends have been cut and the holes have been formed in the base section. Dotted lines indicate the end portions C1, C2 of the side walls that have been removed.

METHOD OF USE

The method of use of the beams is fully described and illustrated in my copending application Ser. No. 812,570 filed July 5, 1977 and now U.S. Pat. No. 4,149,346 which has been referred to above, with the particular beam here illustrated being beam 40' of the copending application.

CRITICAL DIMENSIONS

In the presently preferred embodiment of the beam as illustrated in the present drawings the width of the flat central base section 20 is more than twice the width of each of the side walls 21, 26. This ratio permits a large amount of insulating material to be placed between an exterior panel member that would be attached to the outer surface of wall 21 and an interior panel member that would be attached to the outer surface of wall 26.

In any event, this advantage of a large amount of insulating material can best be achieved when the width of the flat central base section is no more than twice the height of each side wall, i.e., the height of each side wall is no more than half the width of the flat central base section.

MODIFICATIONS

While it is presently preferred to curl the extremities of the side walls by bending them in flat sections or flanges as shown, it is also possible to curl the edges in a rounded or semi-circular configuration. That can be done because while the curled edges are very important to provide the desired structural strength of the beam, there is nothing attached directly to them, and hence no one particular precise shape is required for them.

If a wall section is to be constructed in the form of an equilateral triangle, then the angles at which the two ends of the beam are cut will be equal, and angle A and B will each have a magnitude approximating 20 degrees.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

I claim:

1. In the art of constructing a geodesic dome from flat triangular wall sections which are joined together at an exterior angle of more than 180 degrees, and where each wall section includes three beams incorporated within corresponding side edges thereof, the method of making one of said beams comprising the steps of:

selecting a generally rectangular sheet of metal;

bending the metal sheet along a parallel pair of longitudinal lines to provide a flat central base section and a pair of flat side walls which are parallel to each other but are not perpendicular to the base section, one of said side walls being inwardly inclined and the other being outwardly inclined;

curling the outer extremities of both of said side walls inwardly towards said base section;

cutting each end of the beam along a plane that is perpendicular to said side walls and at an acute angle to the plane of said base section so that the curled extremities of said side walls are shorter than said base section, and so that the ends of three similar beams can be butted together to form a triangle; and forming a plurality of holes in said base section to facilitate fastening it in back-to-back relation to the base section of another similar beam that is incorporated within the side edge of an adjoining wall section.

2. The method of claim 1 including providing each of said side walls, after the extremity thereof has been curled, with a height which is less than half the width of said base section.

3. The method of claim 1 including providing each of said side walls, after the extremity thereof has been curled, with a height which is no more than half the width of said base section.

* * * * *